US005163558A

United States Patent [19]

Palumbo et al.

[11] Patent Number: 5,163,558

[45] Date of Patent: Nov. 17, 1992

[54] PACKAGE HAVING SANITARY PRODUCTS THEREIN

[75] Inventors: Gianfranco Palumbo; Achille DiCintio, both of Pescara, Italy

[73] Assignee: Faricerca SpA, Pescara, Italy

[21] Appl. No.: 873,333

[22] Filed: Apr. 20, 1992

Related U.S. Application Data

[63] Continuation of Ser. No. 673,557, Mar. 22, 1991, abandoned.

[30] Foreign Application Priority Data

Mar. 23, 1990 [IT] Italy ..... 67217 A/90

[51] Int. Cl.[5] ..... B65D 71/06

[52] U.S. Cl. ..... 206/494; 221/302; 221/309; 383/209

[58] Field of Search ..... 206/494, 812, 610, 634, 206/628, 624; 221/63, 302, 303, 309; 383/207-209

[56] References Cited

U.S. PATENT DOCUMENTS 3,583,597 6/1971 Buttery et al. ..... 206/494 X
3,606,080 9/1971 Lynch et al. .
4,030,596 6/1977 Snyder et al. .
4,285,428 8/1981 Beddall et al. .
4,934,535 6/1990 Muckenfuhs et al. ..... 206/610
4,966,286 10/1990 Muckenfuhs ..... 206/610
5,036,978 8/1991 Frank et al. ..... 206/494
5,054,619 10/1991 Muckenfuhs ..... 206/494 X

FOREIGN PATENT DOCUMENTS 0185218 6/1986 European Pat. Off. .
0203806 12/1986 European Pat. Off. .
1212431 11/1970 United Kingdom .
2035258 6/1980 United Kingdom ..... 206/610

OTHER PUBLICATIONS

United Kingdom Search Report.

*Primary Examiner*—Bryon P. Gehman
*Attorney, Agent, or Firm*—Sughrue, Mion, Zinn, Macpeak & Seas

[57] ABSTRACT

A package for sanitary products comprises a wrapper which houses the products and can be torn so as to form at least one hole for the removal of the products. The hole facilitates the removal of the products while ensuring that the wrapper remains unimpaired and retains its shape and size over a longer period.

1 Claim, 2 Drawing Sheets

PACKAGE HAVING SANITARY PRODUCTS THEREIN

This is a continuation of application Ser. No. 07/673,557 filed Mar. 22, 1991, now abandoned.

DESCRIPTION

1. Field of the Invention

The present invention relates to packages for sanitary products and, more specifically, is concerned with a package comprising a wrapper which houses the products and can be torn so as to form a hole for the removal of the products.

2. Description of the prior art

Packages of the type specified are widely known in the art.

In the simplest embodiments, packages of the type specified above are constituted simply by envelopes of sheet materials (for example plastics films) each having one or more closure lines or regions which are formed by gluing, heat-sealing, ultrasonic welding, etc., and can be torn so that the products can be taken out of the package.

From the point of view of their use, these packages usually have the disadvantage that it is difficult to control the tearing of the wrapper which usually takes place in an irregular manner with the risk that the products may fall out of the package.

An improvement consists of the provision of predetermined tear-lines in the packages, for example, by punching which usually affects one entire side of the package or at any rate is such as to define a hole with dimensions generally larger than those of the individual products in the package.

This solution solves the problem of controlling the tearing but substantially impairs the wrapper which cannot retain its shape as its contents are gradually removed and does not eliminate the risk of the products coming out of the package.

A light parallelepipedal cardboard package with tear-strips along the edges of one of its end walls is also used for some types of sanitary products (for example babies' diapers).

The tear-strips can be used to tear the package along three sides of its end face.

The end face can then be turned back to enable the products to be taken out.

This solution also has the disadvantage, amongst others, that the products tend to fall out of the package if its access opening is not kept facing upwardly.

OBJECTS AND SUMMARY OF THE INVENTION

The object of the present invention is to provide a package for sanitary products which does not give rise to the problems mentioned above and which facilitates the removal of the products whilst ensuring that the wrapper remains unimpaired and retains its shape and size over a longer period, thus improving the hygiene of the products and preventing them from coming out accidentally.

According to the present invention, this object is achieved by a package having the characteristics specified in the claims which follow.

BRIEF DESCRIPTION OF THE DRAWINGS

The invention will now be described purely by way of non-limiting example with reference to the appended drawings, in which.

DETAILED DESCRIPTION OF THE INVENTION

Figure 1:
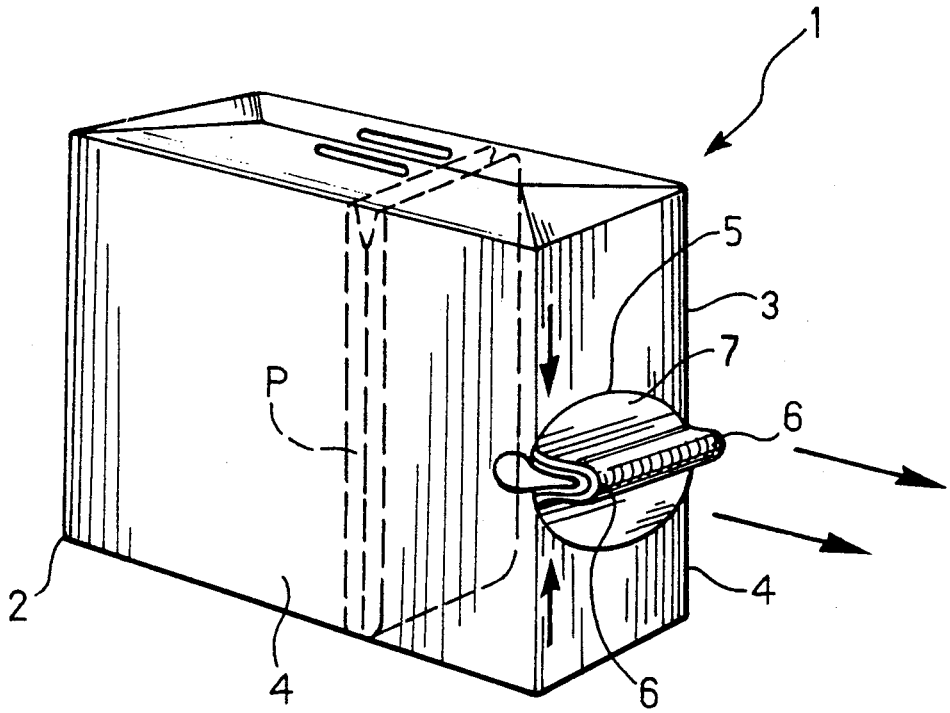
FIG. 1 is a perspective view of a package formed according to the invention.
Figure 2:
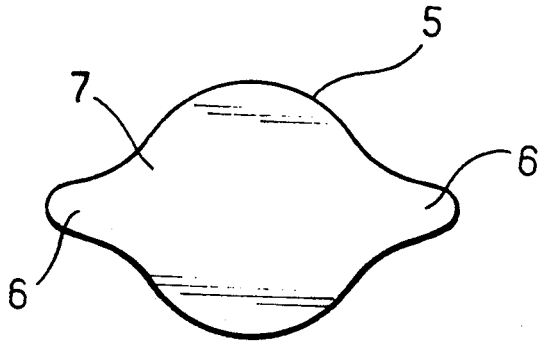
FIG. 2 shows the characteristics of one of the parts shown in FIG. 1, in greater detail.

In the drawings, a package for sanitary products such as disposable babies' diapers P or the like, is generally indicated 1.

The package is constituted substantially by a polyhedral or, more precisely, parallelpipedal wrapper 2.

For example, the wrapper 2 may be constituted by an envelope of a sheet material (such as a plastics film) fitted around the products P which have previously been collected into one or more fairly compact rows.

Alternatively, it may be a wrapper (a box) of light carboard or other semirigid material, in which the diapers P are arranged in one or more rows.

The criteria for the formation of the envelope or box constituting the wrapper 2 and those for the insertion of the products P therein are widely known in the art and do not require a detailed description herein.

The main characteristic of the package of the invention is that it has an end face 3 through which the products P are to be removed.

The end face 3 is between two adjacent faces 4 and is indented by a weakened tear-line 5 constituted, for example, by a line of punching or perforations (formed according to known criteria) extending, for example, substantially in a circle with two lateral appendages or lobes 6 which usually extend into the side faces 4.

In particular, the lobes 6 may either be freely projecting appendages which are intended to be folded against the faces 4 or portions of those faces defined by lines of punching (perforations) which can be torn under pressure.

In use, the user first grips one of the lobes 6.

This can be achieved either by gripping one of the lobes which is folded against one of the faces 4 or, if the lobes 6 are integral parts of those faces, simply by pressing on that part of the end of one of the faces 4 which defines a lobe 6 and subsequently pulling it away from the package.

Once it has been gripped, the lobe 6 can be used as a pull-tab for the exertion of a pull to encourage the wrapper to tear along the line 5 to form a hole in the face 3 and in parts of the two side faces 4.

Each product P has a substantially flat rectangular configuration having a top edge, a bottom edge and opposite side edges with a width substantially equal to the width of the end face 3 of the package. The products P in the embodiment of FIG. 1 are disposed in a single row with the flat faces of the products disposed parallel to the end face 3 of the package.

The dimensions of the hole are generally substantially smaller than at least the largest dimension of each product P and the hole is generally in an intermediate position in the end face 3 and, in any case, is not adjacent the bottom or top of the end face. Thus, the hole is substantially spaced from the top and bottom edges of said products.

Moreover, the products in the package are preferably positioned so that their longest sides face the hole. Once the hole has been formed in the end face 3 of the package, the products P can be taken out in sequence by being gripped on two opposite side edges through the lobe portions 6 which extend along the side faces 4 and being bent slightly as they pass through the hole.

There is no risk of the products falling out of the package accidentially since the dimensions and position of the hole prevent them from coming out spontaneously.

For example, in the embodiment illustrated, the portion 7 of the wrapper which is intended to be removed has a circular central portion with a diameter of about 100 mm whilst the two lateral lobes 6 are about 35 mm high. By way of reference, a babies' diaper in the folded configuration usually used for its packaging is normally considered to have dimensions of the order of 110–120 mm by 220–240 mm.

This means that the product can easily be taken out of the package 1 through the hole produced as a result of the removal of the portion 7 by being bent slightly but cannot, in any event, come out of the package 1 spontaneously.

Figure 3:
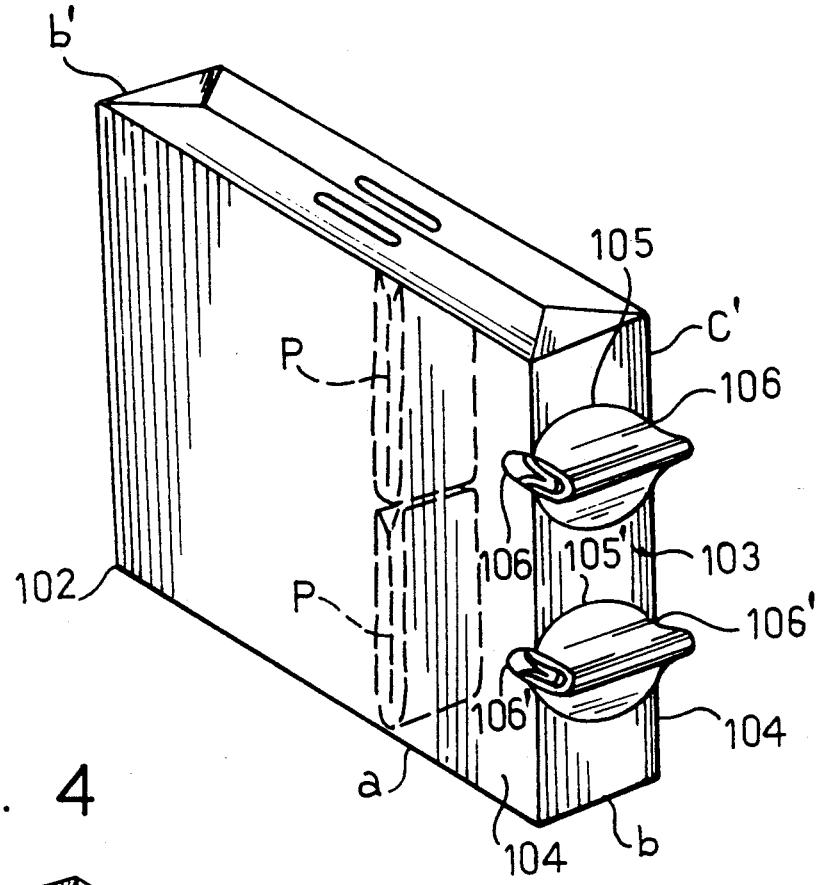
FIG. 3 is a perspective view of an alternative configuration of a package formed according to the invention, containing two superposed rows of sanitary products.
Figure 4:
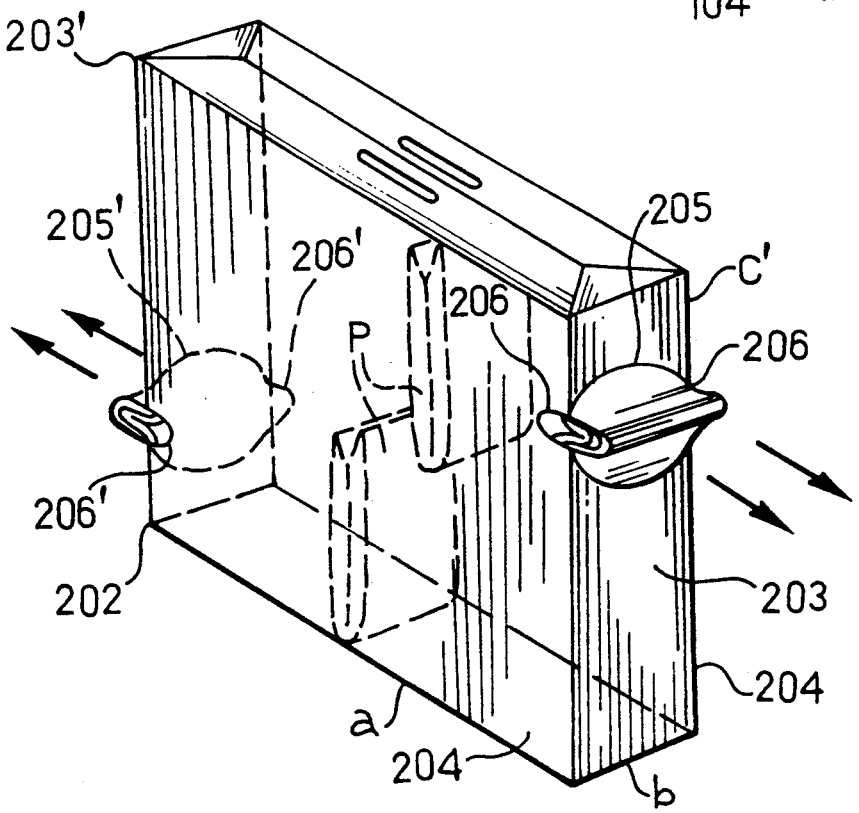
FIG. 4 is a perspective view of a further alternative configuration of a package formed according to the present invention, also containing two superposed rows of sanitary products.

FIGS. 3 and 4 show two alternative embodiments of a package for sanitary products formed according to the present invention and containing two superposed rows of products P which are accessible through two separate opening systems, each exactly equivalent to that described.

The package of FIG. 3 shows the two holes defined by weakened tear-lines 105 and 105' on the same end face 103, each in correspondence with one of the two superposed rows of products P; in FIG. 4, however, the two holes defined by weakened tear-lines 205 and 205' are formed in the end face 203 of the package in correspondence with the upper row of products and in the opposite end face 203' in correspondence with the lower row.

In use, access is conveniently gained first to the products in the upper row by the formation of a hole in correspondence with the line 105 or 205 in the manner already described; access is then gained to the lower row, preferably after the entire upper row has been used, by the formation of the second hole in correspondence with the line 105' or 205'.

Naturally, the principle of the invention remaining the same, its details may be varied widely with respect to those described and illustrated, without thereby departing from the scope of the present invention.

What is claimed is:

1. A package having a plurality of sanitary products therein comprising a wrapper for housing the products and which can be torn so as to form at least one substantially circular hole for the removal of the products wherein:

said wrapper has a polyhedral configuration including a substantially rectangular end face having a length greater than a width disposed between two adjacent side faces disposed substantially perpendicular thereto;

each sanitary product has a substantially flat rectangular configuration having a top edge, a bottom edge and opposite side edges with a width substantially equal to the width of said end face of said wrapper and disposed parallel to said end face; and said wrapper has at least one tear line formed in said end face in substantial spaced relation to said top and bottom edges of said products to define a substantially circular portion of said end face having a diameter substantially equal to the width of said end face between said side faces, said at least one tear line extending into each side face to define a pair of pull tabs each of which is substantially smaller than and continuous with said circular portion of said end face whereby upon removal of said pull tabs and substantially circular portion, a hole will be defined which is substantially smaller than the length of each product contained within the package and whereby the opposite side edges of each product may be gripped through portions of said hole in said side faces for drawing said products out through said hole.

* * * * *